US009354544B2

(12) United States Patent
Sato

(10) Patent No.: US 9,354,544 B2
(45) Date of Patent: May 31, 2016

(54) DEVELOPING DEVICE

(71) Applicant: Shougo Sato, Seto (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/036,021

(22) Filed: Sep. 25, 2013

(65) Prior Publication Data

US 2014/0086638 A1 Mar. 27, 2014

(30) Foreign Application Priority Data

Sep. 26, 2012 (JP) ..... 2012-211737

(51) Int. Cl.
*G03G 15/08* (2006.01)
*G03G 15/04* (2006.01)

(52) U.S. Cl.
CPC ..... *G03G 15/0812* (2013.01); *G03G 15/0891* (2013.01)

(58) Field of Classification Search
CPC ..... G03G 15/0812; G03G 15/0891
USPC ..... 399/252, 258, 22, 263, 264, 119, 222
See application file for complete search history.

(56) References Cited

U.S. PATENT DOCUMENTS 4,026,241 A * 5/1977 Takebe et al. ..... 399/256
7,099,612 B2 8/2006 Choi et al.
7,184,693 B2 2/2007 Choi et al.
7,373,098 B2 5/2008 Choi et al.
7,697,858 B2 4/2010 Moon et al.
8,107,850 B2 1/2012 Xu et al.
2005/0111887 A1* 5/2005 Choi et al. ..... 399/281
2005/0185974 A1* 8/2005 Terai ..... 399/30

(Continued)

FOREIGN PATENT DOCUMENTS

JP 04063378 A * 2/1992 ..... G03G 15/08
JP H07-219329 A 8/1995

(Continued)

OTHER PUBLICATIONS

Dec. 1, 2015—(JP) Notification of Reason for Refusal—App 2012-211737, Eng Tran.

(Continued)

*Primary Examiner* — Billy Lactaoen
(74) *Attorney, Agent, or Firm* — Banner & Witcoff, Ltd.

(57) ABSTRACT

A developing device includes: a developing frame having an opening; a developing roller that is arranged to the opening and is configured to carry developer; a supply roller configured to supply the developer to the developing roller, and a layer thickness regulation member configured to regulate a layer thickness of the developer carried on the developing roller. The developing frame includes: a developer accommodation chamber configured to accommodate the developer; a developer supply chamber configured to supply the developer, which is supplied from the developer accommodation chamber, to the supply roller; a developer return chamber that is arranged above the developer supply chamber and is configured to return the developer, which is scraped off by the layer thickness regulation member, to the developer accommodation chamber. The developer return chamber is provided with a developer returning unit configured to convey the developer to the developer accommodation chamber.

15 Claims, 10 Drawing Sheets

1

(56) References Cited

U.S. PATENT DOCUMENTS

| | | | | |
|---|---|---|---|---|
| 2006/0222412 | A1* | 10/2006 | Ito et al. | 399/258 |
| 2008/0187366 | A1 | 8/2008 | Moon et al. | |
| 2009/0190952 | A1 | 7/2009 | Xu et al. | |
| 2010/0135701 | A1 | 6/2010 | Lee et al. | |
| 2010/0329734 | A1 | 12/2010 | Hayakawa et al. | |
| 2011/0052265 | A1 | 3/2011 | Kim et al. | |
| 2012/0134721 | A1 | 5/2012 | Abe et al. | |

FOREIGN PATENT DOCUMENTS

| | | | |
|---|---|---|---|
| JP | H10-293452 | A | 11/1998 |
| JP | 2001-194901 | A | 7/2001 |
| JP | 2002-268382 | A | 9/2002 |
| JP | 2005-031387 | A | 2/2005 |
| JP | 2009-180772 | A | 8/2009 |
| JP | 2011-013367 | A | 1/2011 |
| JP | 2011-085847 | A | 4/2011 |
| JP | 2012-118261 | A | 6/2012 |

OTHER PUBLICATIONS

Apr. 5, 2016—(JP) Notification of Reason for Refusal—App 2012-211737, Eng Tran.

* cited by examiner

DEVELOPING DEVICE

CROSS-REFERENCE TO RELATED APPLICATION

This application is based upon and claims the benefit of priority of Japanese Patent Application No. 2012-211737 filed on Sep. 26, 2012, the contents of which are incorporated herein by reference in its entirety.

BACKGROUND

The disclosure relates to a developing device that is provided to an electrophotographic image forming apparatus.

An electrophotographic image forming apparatus has been known which has an image carrier, on which an electrostatic latent image is formed, and a developing cartridge that supplies developer to the image carrier.

For example, a laser printer has been known which has a process frame having a photosensitive drum, a developing roller carrying toner thereon and a developing cartridge detachably mounted to the process frame.

The developing cartridge provided to the laser printer further has a supply roller that supplies toner to the developing roller and a layer thickness regulation blade that regulates a thickness of the toner carried on the developing roller.

SUMMARY

When it is intended to increase a printing speed, it is considered to increase a supply speed of the toner from the developing cartridge to the photosensitive drum.

When increasing the toner supply speed, it is necessary to increase the supply speed of the toner from the supply roller to the developing roller.

However, when increasing the supply speed of the toner from the supply roller to the developing roller, a large amount of the toner may stay in the vicinity of the developing roller during an image forming operation and the staying toner may be leaked through between the layer thickness regulation blade and the developing roller.

Therefore, an object of an aspect of the present disclosure is to provide an image forming apparatus capable of preventing developer from being leaked from a vicinity of a developing roller even when a supply speed of the developer from a supply roller to the developing roller is increased.

The aspect of the present disclosure provides the following arrangement:

A developing device comprising:

a developing frame having an opening that extends in a longitudinal direction thereof;

a developing roller that is arranged to the opening and is configured to carry developer;

a supply roller that is configured to supply the developer to the developing roller, and a layer thickness regulation member that is configured to regulate a layer thickness of the developer carried on the developing roller, wherein the developing frame includes:

a developer accommodation chamber configured to accommodate the developer;

a developer supply chamber configured to supply the developer, which is supplied from the developer accommodation chamber, to the supply roller;

a developer return chamber that is arranged above the developer supply chamber and is configured to return the developer, which is scraped off from the developing roller by the layer thickness regulation member, to the developer accommodation chamber; and a partition wall that is disposed adjacent to the supply roller and partitions the developer supply chamber and the developer return chamber;

wherein the developer supply chamber is provided with a developer conveying unit configured to convey the developer to the supply roller, and wherein the developer return chamber is provided with a first developer returning unit that faces the layer thickness regulation member and is configured to convey the developer in a direction orthogonal to an axis line of the supply roller to convey the developer to the developer accommodation chamber.

DESCRIPTION OF EXEMPLARY EMBODIMENTS

1. Overall Configuration of Printer

Figure 1:
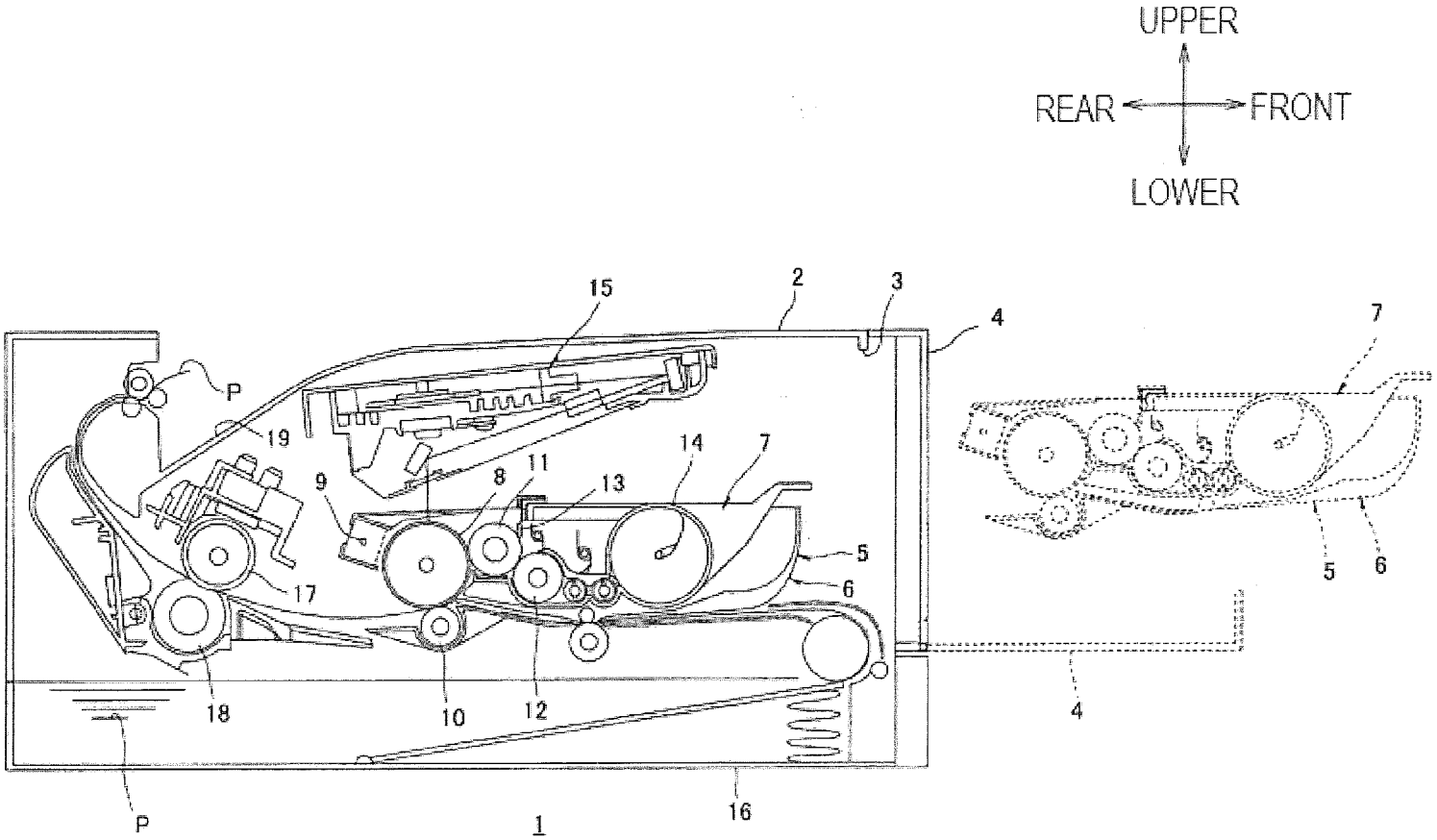
FIG. 1 is a central sectional view of a printer having a developing cartridge according to a first exemplary embodiment.

As shown in FIG. 1, a printer 1 is an electrophotographic monochrome printer.

Meanwhile, in the below descriptions, the directions are described on the basis of a state where the printer 1 is horizontally put. That is, a sheet upper side of FIG. 1 is an upper side and a sheet lower side is a lower side. A sheet right side of FIG. 1 is a front side and a sheet left side of FIG. 1 is a rear side. The left and the right are described on the basis of a state where the printer 1 is seen from the front side. That is, a sheet front side of FIG. 1 is a left side and a sheet inner side is a right side. In the meantime, an upper-lower direction is an example of a first direction, a front-rear direction is an example of a second direction and a left-right direction is an example of a third direction. The upper side is an example of one side of the first direction and the lower side is an example of the other side of the first direction. The front side is an example of one side of the second direction and the rear side is an example of the other side of the second direction. The left side is an example of one side of the third direction and the right side is an example of the other side of the third direction.

The printer 1 includes a body casing 2 having a substantial box shape. A front wall of the body casing 2 is provided with a front cover 4 opening and closing a body opening 3 so that it can be rotated about a rear end portion thereof serving as a support point. The printer 1 includes a process cartridge 5.

The process cartridge 5 is detachably accommodated in the body casing 2. The process cartridge 5 includes a drum cartridge 6 and a developing cartridge 7 that is detachably mounted to the drum cartridge 6 and is an example of the developing device.

The drum cartridge 6 includes a photosensitive drum 8, a scorotron-type charger 9 and a transfer roller 10.

The photosensitive drum 8 is rotatably supported to a rear end portion of the drum cartridge 6. The photosensitive drum 8 has a substantial cylinder shape that is rectangular in the left-right direction.

The scorotron-type charger 9 is arranged to face the photosensitive drum 8 at an interval from a rear-upper side of the photosensitive drum 8.

The transfer roller 10 is arranged to face a lower side of the photosensitive drum 8 and is press-contacted to the photosensitive drum 8 from the lower side.

The developing cartridge 7 includes a developing roller 11, a supply roller 12 and a layer thickness regulation blade 13 that is an example of the layer thickness regulation member.

The developing roller 11 is rotatably supported to a rear end portion of the developing cartridge 7 so that it is exposed from the rear side. The developing roller 11 is contacted to the photosensitive drum 8 from the front side.

The supply roller 12 is rotatably supported to a front-lower side of the developing roller 11 at a rear end portion of the developing cartridge 7. The supply roller 12 is contacted to the developing roller 11 from the front-lower side.

The layer thickness regulation blade 13 is fixed to the upper side of the developing roller 11 at the rear end portion of the developing cartridge 7. The layer thickness regulation blade 13 has a substantially flat plate shape that extends in the upper-lower direction and is rectangular in the left-right direction, and is contacted at its lower end portion to the developing roller 11 from the front side.

In the meantime, the developing cartridge 7 is provided at its front end portion with a toner accommodation chamber 14 that is an example of the developer accommodation chamber accommodating toner, which is an example of the developer.

The toner in the toner accommodation chamber 14 is positively friction-charged between the supply roller 12 and the developing roller 11, and is carried on a surface of the developing roller 11 as a thin layer having a predetermined thickness by the layer thickness regulation blade 13.

In the meantime, a surface of the photosensitive drum 8 is uniformly charged by the photosensitive drum 8 and is then exposed based on predetermined image data by a scanner unit 15 that is arranged to face the upper side of the photosensitive drum 8. Thereby, an electrostatic latent image based on the image data is formed on the surface of the photosensitive drum 8. The toner carried on the developing roller 11 is supplied to the electrostatic latent image on the surface of the photosensitive drum 8, so that a toner image (developer image) is carried on the surface of the photosensitive drum 8.

Sheets P are accommodated in a sheet feeding tray 16 that is provided at a bottom part of the body casing 2, are conveyed to U-turn towards the rear-upper side by a variety of rollers and are fed one by one between the photosensitive drum 8 and the transfer roller 10 at predetermined timing. When the sheet passes from the front side towards the rear side through between the photosensitive drum 8 and the transfer roller 10, the toner image is transferred onto the sheet P.

When the sheet P passes between a heating roller 17 and a pressing roller 18, it is heated and pressed. At this time, the toner image is heat-fixed on the sheet P.

After that, the sheet P is conveyed to U-turn towards the front-upper side and is then discharged onto a sheet discharge tray 19 that is provided on an upper surface of the body casing 2.

2. Developing Cartridge (1) Developing Frame

Figure 2:
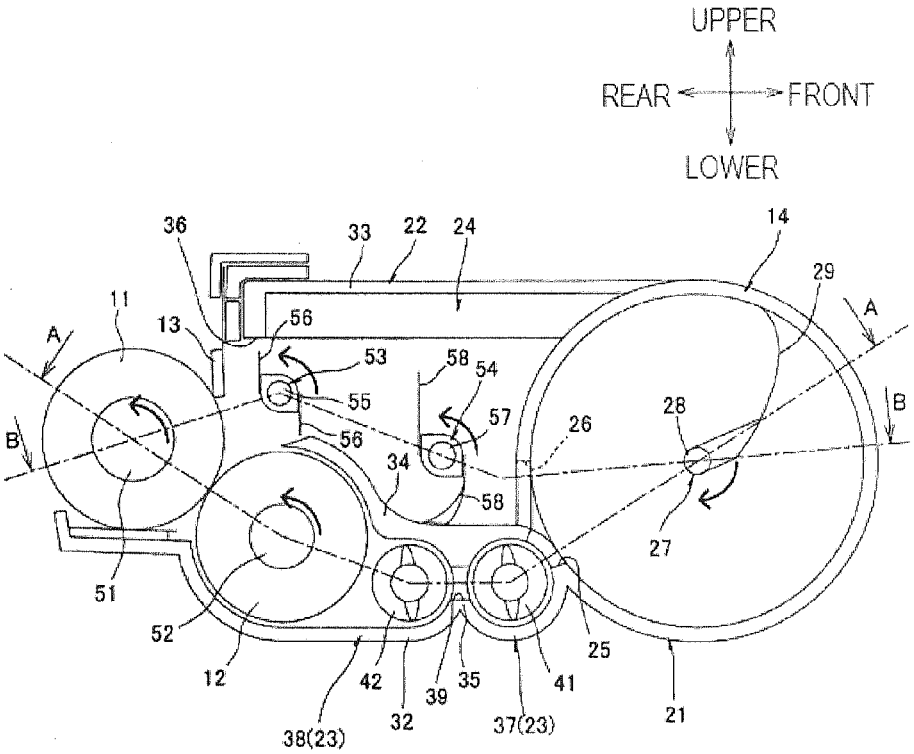
FIG. 2 is a side sectional view of the developing cartridge shown in FIG. 1.
Figure 3:
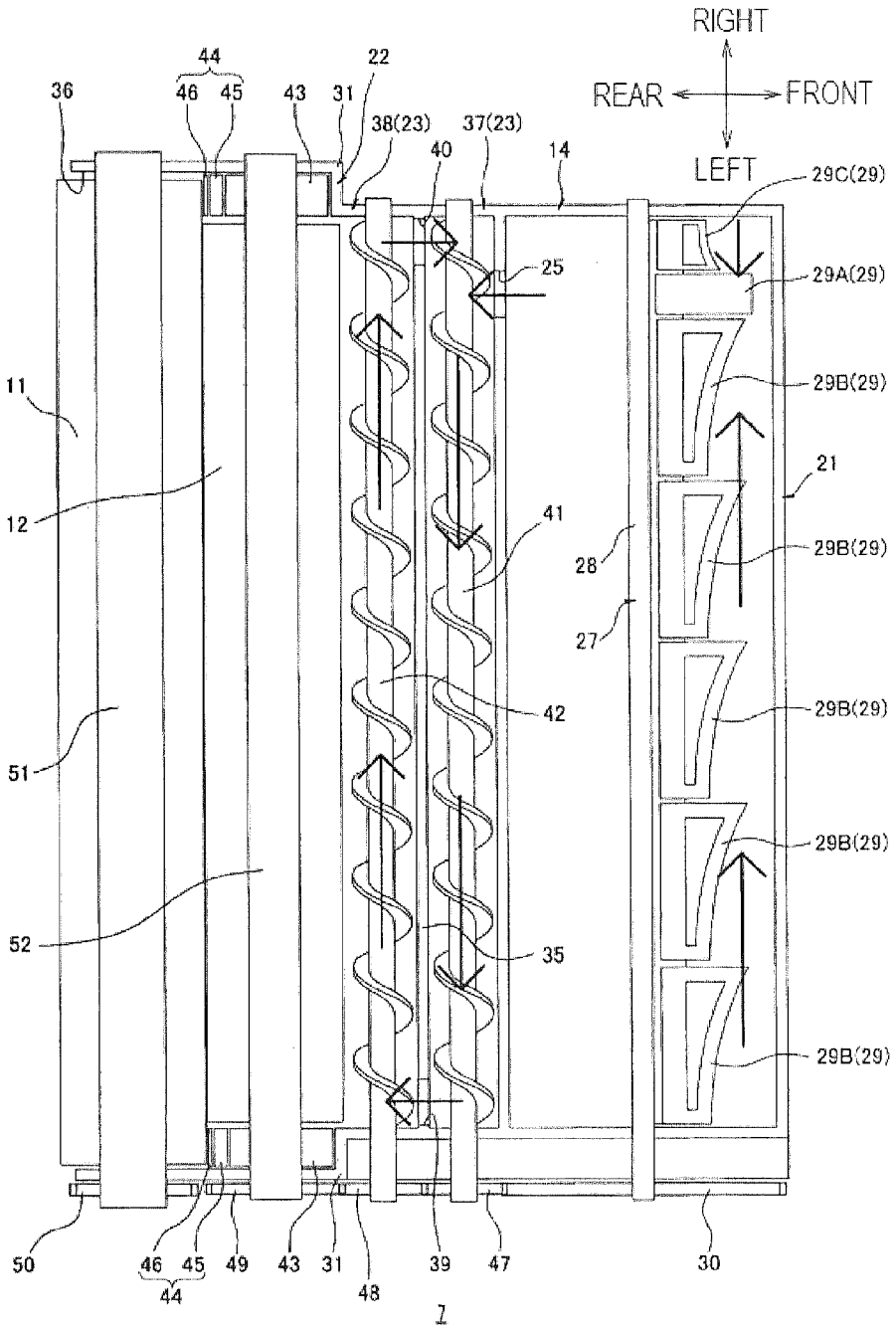
FIG. 3 is an A-A sectional view of FIG. 2.
Figure 4:
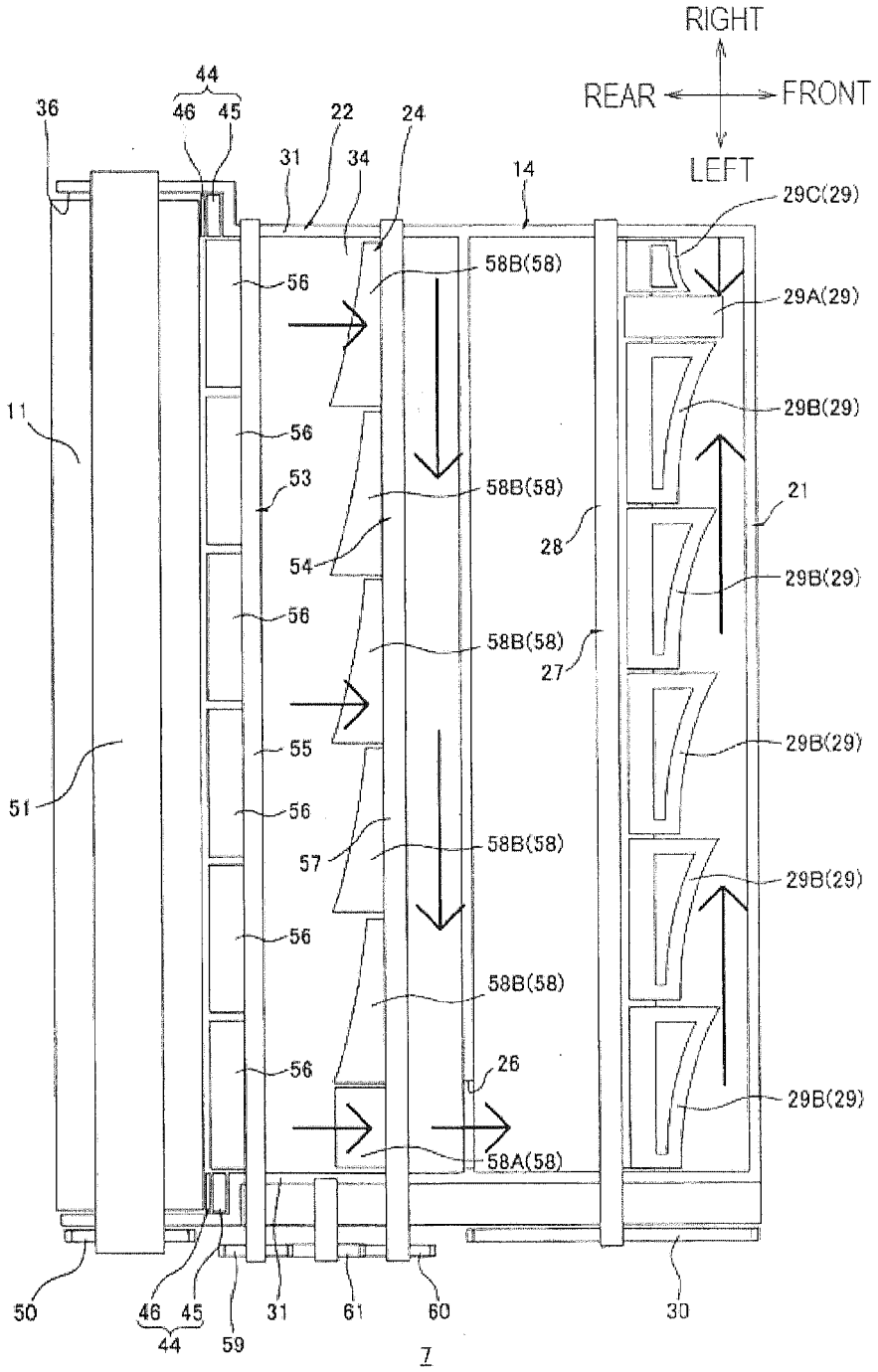
FIG. 4 is a B-B sectional view of FIG. 2.

As shown in FIGS. 2 to 4, the developing cartridge 7 includes a developing frame 21.

The developing frame 21 includes the toner accommodation chamber 14 and a developing unit 22.

The toner accommodation chamber 14 configures a front half part of the developing frame 21. The toner accommodation chamber 14 has a substantial cylinder shape which extends in the left-right direction and in which both left and right end portions are closed. The toner accommodation chamber 14 is formed with a supply port 25 and a return port 26.

The supply port 25 penetrates a right end portion of a rear-lower peripheral wall of the toner accommodation chamber 14 in a direction of connecting the front-upper side and the rear-lower side.

The return port 26 is arranged above the supply port 25 and penetrates a left end portion of a rear peripheral wall of the toner accommodation chamber 14 in the front-rear direction.

The developing unit 22 extends rearwards from the toner accommodation chamber 14 and configures a rear half part of the developing frame 21. The developing unit 22 has a substantial square column shape which extends in the left-right direction and in which both left and right end portions are closed.

Specifically, the developing unit 22 includes a pair of left and right sidewalls 31, a lower wall 32 and an upper wall 33.

Each of the pair of sidewalls 31 extends forwards continuously from each rear end portion of both sidewalls of the toner accommodation chamber 14 in the left-right direction and has a substantially rectangular flat plate shape, when seen from a side. Rear end portions of the sidewalls 31 protrude outwards in the left-right direction at parts supporting the developing roller 11 and the supply roller 12.

The lower wall 32 has a substantially flat plate shape that extends forwards continuously from the lower side of the supply port 25 at a lower end portion of the toner accommodation chamber 14. The lower wall 32 is built between the lower end portions of the pair of sidewalls 31.

The upper wall 33 has a substantially flat plate shape that extends forwards continuously from an upper end portion of the toner accommodation chamber 14. The upper wall 33 is built between upper end portions of the pair of sidewalls 31. A rear end portion of the upper wall 33 is arranged at an interval from the front-upper side of a lower end portion of the lower wall 32.

That is, a rear end portion of the developing frame 21 is formed with an opening 36 that is defined by the rear end portions of the pair of sidewalls 31, the rear end portion of the lower wall 32 and the rear end portion of the upper wall 33.

An upper end portion of the layer thickness regulation blade 13 is fixed to the rear end portion of the upper wall 33. The developing roller 11 is rotatably supported to the upper side of the rear end portion of the lower wall 32 so that it is contacted to a lower end portion of the layer thickness regulation blade 13 from the rear side. Thereby, the opening 36 is closed by the layer thickness regulation blade 13 and the developing roller 11.

In the meantime, a right end portion of a rotary shaft (a developing roller shaft 51) of the developing roller 11 is rotatably supported to the right sidewall 31. A left end portion of the developing roller shaft 51 is rotatably supported to the left sidewall 31 so that it protrudes leftwards from the left sidewall 31. A developing roller driving gear 50 is supported to the left end portion of the developing roller shaft 51 at the left side of the left sidewall 31 so that it cannot be relatively rotated.

The developing roller driving gear 50 has a substantial disc plate shape having a thickness in the left-right direction. A periphery of the developing roller driving gear 50 is formed with gear teeth over an entire circumference thereof.

The developing unit 22 is provided therein with a first partition wall 34 and a second partition wall 35, which are examples of the partition wall.

The first partition wall 34 has a substantially flat plate shape that extends forwards continuously from the upper side of the supply port 25 and the lower side of the return port 26 at the lower end portion of the toner accommodation chamber 14. A front half part of the first partition wall 34 horizontally extends in the front-rear direction. A rear half part of the first partition wall 34 extends in a rear-upper direction and is bent rearwards as it is directed towards the rear-upper side so that it follows an outer periphery of the supply roller 12. A rear end portion of the first partition wall 34 is arranged to face the developing roller 11 at an interval from the front side of the developing roller 11 at the upper side of the upper end portion of the supply roller 12.

An internal space of the developing unit 22 is partitioned into a toner supply chamber 23, which is an example of the developer supply chamber below the first partition wall 34, and a toner return chamber 24, which is an example of the developer return chamber above the first partition wall 34, by the first partition wall 34.

The second partition wall 35 has a substantially flat plate shape extending in the upper-lower direction so that it continues to a substantial center of the front half part of the first partition wall 34 in the front-rear direction and to the lower wall 32. The second partition wall 35 is formed with a toner supply port 39 and a toner collection port 40.

The toner supply port 39 penetrates a left end portion of the second partition wall 35 in the front-rear direction.

The toner collection port 40 penetrates a right end portion of the second partition wall 35 in the front-rear direction.

An internal space of the toner supply chamber 23 is partitioned into a first supply chamber 37 that is at the front side of the second partition wall 35 and a second supply chamber 38 that is at the rear side of the second partition wall 35 by the second partition wall 35.

(2) Toner Accommodation Unit

The toner accommodation chamber 14 is provided therein with an agitator 27.

The agitator 27 includes an agitator shaft 28 and a plurality of (seven) stirring blades 29.

The agitator shaft 28 is arranged at a substantial center of the toner accommodation chamber 14 in a diametrical direction. The agitator shaft 28 has a substantially cylindrical column shape that extends in the left-right direction. A right end portion of the agitator shaft 28 is rotatably supported to a right wall of the toner accommodation chamber 14. A left end portion of the agitator shaft 28 is rotatably supported to a left wall of the toner accommodation chamber 14 so that it protrudes leftwards from the left wall of the toner accommodation chamber 14. An agitator driving gear 30 is supported to the left end portion of the agitator shaft 28 at the left side of the left wall of the toner accommodation chamber 14 so that it cannot be relatively rotated.

The agitator driving gear 30 has a substantial disc plate shape having a thickness in the left-right direction. A periphery of the agitator driving gear 30 is formed with gear teeth over an entire circumference thereof.

The plurality of stirring blades 29 is arranged in parallel in the left-right direction. The stirring blade 29 is made of a material having flexibility such as resin film and the like and has a substantially rectangular flat plate shape that extends outwards from an outer periphery of the agitator shaft 28 in the diametrical direction of the agitator shaft 28. In the meantime, a free end portion (an outer end portion in the diametrical direction of the agitator shaft 28) of a stirring blade 29A facing the supply port 25 has a substantially linear shape extending in the left-right direction. A free end portion (an outer end portion in the diametrical direction of the agitator shaft 28) of a left stirring blade 29B of the stirring blade 29A facing the supply port 25 is inclined with being bent so that a length (free length) thereof from the agitator shaft 28 becomes shorter towards the left side. A free end portion (an outer end portion in the diametrical direction of the agitator shaft 28) of a right stirring blade 29C of the stirring blade 29A facing the supply port 25 is inclined with being bent so that a length (free length) thereof from the agitator shaft 28 becomes shorter towards the right side.

(3) Toner Supply Chamber

The toner supply chamber 23 is provided therein with a first screw 41, a second screw 42 that is an example of the developer conveying unit and the supply roller 12.

The first screw 41 is arranged in the first supply chamber 37 along the left-right direction. The first screw 41 is an auger screw of a left-hand thread shape that extends in the left-right direction and includes a diameter smaller than the supply roller 12. A right end portion of the first screw 41 is rotatably supported to the right sidewall 31. A left end portion of the first screw 41 is rotatably supported to the left sidewall 31 so that it protrudes leftwards from the left sidewall 31. A first screw driving gear 47 is supported to the left end portion of the first screw 41 at the left side of the left sidewall 31 so that it cannot be relatively rotated.

The first screw driving gear 47 has a substantial disc plate shape having a thickness in the left-right direction. A periphery of the first screw driving gear 47 is formed with gear teeth over an entire circumference thereof. The first screw driving gear 47 is meshed with the agitator driving gear 30 from the rear side.

The second screw 42 is arranged in a front end portion of the second supply chamber 38 along the left-right direction. The second screw 42 is an auger screw of a left-hand thread shape that extends in the left-right direction and includes a diameter smaller than the supply roller 12. The second screw 42 is arranged so that a lower end portion thereof overlaps with the lower end portion of the supply roller 12, when projected in the front-rear direction. That is, a rotating center of the second screw 42 is arranged to be lower than a rotating center of the supply roller 12. A right end portion of the second screw 42 is rotatably supported to the right sidewall 31. A left end portion of the second screw 42 is rotatably supported to the left sidewall 31 so that it protrudes leftwards from the left sidewall 31. A second screw driving gear 48 is supported to the left end portion of the second screw 42 at the left side of the left sidewall 31 so that it cannot be relatively rotated.

The second screw driving gear 48 has a substantial disc plate shape having a thickness in the left-right direction. A periphery of the second screw driving gear 48 is formed with gear teeth over an entire circumference thereof. The second screw driving gear 48 is meshed with the first screw driving gear 47 from the rear side.

The supply roller 12 is arranged at the rear end portion of the toner supply chamber 23. A right end portion of a rotary shaft (a supply roller shaft 52) of the supply roller 12 is rotatably supported to the right sidewall 31. A left end portion of the supply roller shaft 52 is rotatably supported to the left sidewall 31 so that it protrudes leftwards from the left sidewall 31. A supply roller driving gear 49 is supported to the left end portion of the supply roller shaft 52 at the left side of the left sidewall 31 so that it cannot be relatively rotated.

The supply roller driving gear 49 has a substantial disc plate shape having a thickness in the left-right direction. A periphery of the supply roller driving gear 49 is formed with gear teeth over an entire circumference thereof. The supply roller driving gear 49 is meshed with the second screw driving gear 48 from the rear side.

The toner supply chamber 23 is provided therein with shaft seals 43 and side seals 44.

The shaft seals 43 are respectively fitted on outer sides of both end portions of the supply roller shaft 52 at inner sides of the sidewalls 31 in the left-right direction. The shaft seal 43 is made of a material having elasticity such as sponge and the like, has a substantially flat plate shape having a thickness in the left-right direction and seals a gap between the supply roller shaft 52 and the sidewall 31.

The side seal 44 is interposed between the shaft seal 43 and the developing roller 11. The side seal 44 includes a first seal member 45 that is contacted to the shaft seal 43 and a second seal member 46 that is contacted to the circumferential surface of the developing roller 11.

The first seal member 45 is made of a material having elasticity such as sponge and the like and has a substantially flat plate shape having a thickness in the front-rear direction.

The second seal member 46 is made of non-woven fabric such as flocked fabric and the like and is adhered to a rear surface of the first seal member 45 so that it follows the circumferential surface of the developing roller 11.

(4) Toner Return Chamber

The toner return chamber 24 is provided therein with a first conveyance member 53 that is an example of the first developer returning unit and a second conveyance member 54 that is an example of the second developer returning unit.

The first conveyance member 53 is arranged above the supply roller 12 at the front side of the layer thickness regulation blade 13. The first conveyance member 53 includes a shaft 55 and a plurality of (six) blades 56.

The shaft 55 has a substantially cylindrical column shape extending in the left-right direction. A right end portion of the shaft 55 is rotatably supported to the right sidewall 31. A left end portion of the shaft 55 is rotatably supported to the left sidewall so that it protrudes leftwards from the left sidewall 31. A first conveyance member driving gear 59 is supported to the left end portion of the shaft 55 at the left side of the left sidewall 31 so that it cannot be relatively rotated.

The first conveyance member driving gear 59 has a substantial disc plate shape having a thickness in the left-right direction. A periphery of the first conveyance member driving gear 59 is formed with gear teeth over an entire circumference thereof.

The plurality of blades 56 is arranged in parallel in the left-right direction. The blade 56 is made of a material having flexibility such as resin film and the like and has a substantially rectangular flat plate shape that extends outwards from an outer periphery of the shaft 55 in a diametrical direction of the shaft 55.

The second conveyance member 54 is arranged at an interval from the front-lower side of the first conveyance member 53 at the rear side of the return port 26. The second conveyance member 54 includes a shaft 57 and a plurality of (six) blades 58.

The shaft 57 has a substantially cylindrical column shape extending in the left-right direction. A right end portion of the shaft 57 is rotatably supported to the right sidewall 31. A left end portion of the shaft 57 is rotatably supported to the left sidewall 31 so that it protrudes leftwards from the left sidewall 31. A second conveyance member driving gear 60 is supported to the left end portion of the shaft 57 at the left side of the left sidewall 31 so that it cannot be relatively rotated.

The second conveyance member driving gear 60 has a substantial disc plate shape having a thickness in the left-right direction. A periphery of the second conveyance member driving gear 60 is formed with gear teeth over an entire circumference thereof. The second conveyance member driving gear 60 is meshed with the first conveyance member driving gear 59 through an intermediate gear 61.

The plurality of blades 58 is arranged in parallel in the left-right direction. The blade 58 is made of a material having flexibility such as resin film and the like and has a substantially rectangular flat plate shape that extends outwards from an outer periphery of the shaft 57 in a diametrical direction of the shaft 57. In the meantime, a free end portion (an outer end portion in the diametrical direction of the shaft 57) of a blade 58A facing the return port 26 has a substantially linear shape extending in the left-right direction. A free end portion (an outer end portion in the diametrical direction of the shaft 57) of a right stirring blade 58B of the blade 58A facing the return port 26 is inclined with being bent so that a length (free length) thereof from the shaft 57 becomes shorter towards the right side.

(5) Driving of Developing Cartridge

When a driving force is input from a driving transmission member (not shown) in the body casing 2 to a passive member (not shown) of the developing cartridge 7, the driving force is input from the passive member to the developing roller driving gear 50, the supply roller driving gear 49 and the first conveyance member driving gear 59, so that the developing roller driving gear 50, the supply roller driving gear 49 and the first conveyance member driving gear 59 are rotated in a counterclockwise direction, when seen from the left side surface.

Then, as shown in FIGS. 2 and 3, the driving force is input from the developing roller driving gear 50 to the developing roller shaft 51, so that the developing roller 11 is rotated in the counterclockwise direction, when seen from the left side surface.

The driving force is input from the supply roller driving gear 49 to the supply roller shaft 52, so that the supply roller 12 is rotated in the counterclockwise direction, when seen from the left side surface.

Then, the driving force is transmitted to the second screw driving gear 48 meshed with the supply roller driving gear 49, so that the second screw driving gear 48 is rotated in a clockwise direction, when seen from the left side surface.

Thereby, the driving force is input from the second screw driving gear 48 to the second screw 42, so that the second screw 42 is rotated in the clockwise direction, when seen from the left side surface.

The driving force is transmitted to the first screw driving gear 47 meshed with the second screw driving gear 48, so that the first screw driving gear 47 is rotated in the counterclockwise direction, when seen from the left side surface.

Thereby, the driving force is input from the first screw driving gear 47 to the first screw 41, so that the first screw 41 is rotated in the counterclockwise direction, when seen from the left side surface.

The driving force is transmitted to the agitator driving gear 30 meshed with the first screw driving gear 47, so that the agitator driving gear 30 is rotated in the clockwise direction, when seen from the left side surface.

Thereby, the driving force is input from the agitator driving gear 30 to the agitator shaft 28, so that the agitator 27 is rotated in the clockwise direction, when seen from the left side surface.

As shown in FIGS. 2 and 4, when the driving force is input from the passive member (not shown) to the first conveyance member driving gear 59, the driving force is input from the first conveyance member driving gear 59 to the shaft 55, so that the first conveyance member 53 is rotated in the counterclockwise direction, when seen from the left side surface.

Then, the driving force is transmitted to the second conveyance member driving gear 60 through the intermediate gear 61, so that the second conveyance member driving gear 60 is rotated in the counterclockwise direction, when seen from the left side surface.

Thereby, the driving force is input from the second conveyance member driving gear 60 to the shaft 57, so that the second conveyance member 54 is rotated in the counterclockwise direction, when seen from the left side surface.

3. Toner Supply Operation

As shown in FIGS. 2 and 3, when the developing cartridge 7 is driven, the toner in the toner accommodation chamber 14 is supplied into the first supply chamber 37 through the supply port 25 by the rotation of the agitator 27.

The toner supplied into the first supply chamber 37 is conveyed from the right side to the left side in the first supply chamber 37 and is supplied into the second supply chamber 38 through the toner supply port 39 by rotation of the first screw 41.

The toner supplied into the second supply chamber 38 is conveyed from the left side to the right side in the second supply chamber 38 by the rotation of the second screw 42 and is carried on the surface of the supply roller 12 during the conveyance.

In the meantime, the toner that is not carried on the surface of the supply roller 12 is continuously conveyed from the left side to the right side in the second supply chamber 38 by the rotation of the second screw 42 and is collected into the first supply chamber 37 through the toner collection port 40. That is, the toner is circulated between the first supply chamber 37 and the second supply chamber 38 in the toner supply chamber 23.

The toner carried on the surface of the supply roller 12 is friction-charged in a nip portion between the developing roller 11 and the supply roller 12 and is then carried on the surface of the developing roller 11.

The toner carried on the surface of the developing roller 11 is regulated in terms of a thickness thereof by the layer thickness regulation blade 13 so that it becomes a thin layer having a predetermined thickness.

At this time, the surplus toner of the toner carried on the surface of the developing roller 11 is scraped off by the layer thickness regulation blade 13.

The toner scraped off by the layer thickness regulation blade 13 is dropped to the nip portion between the developing roller 11 and the supply roller 12 by an own weight thereof.

The toner dropped to the nip portion between the developing roller 11 and the supply roller 12 is conveyed forwards by the rotation of the first conveyance member 53, as shown in FIGS. 3 and 4.

Then, the toner conveyed by the first conveyance member 53 is slid along the inclination of the rear half part of the first partition wall 34 and is then dropped onto the front half part of the first partition wall 34.

The toner slid and dropped onto the front half part of the first partition wall 34 is conveyed from the right side to the left side by the rotation of the second conveyance member 54 and is then collected into the toner accommodation chamber 14 through the return port 26.

4. Operational Effects (1) As shown in FIG. 2, according to the developing cartridge 7, the toner that is accommodated in the toner accommodation chamber 14 is supplied to the supply roller 12 through the first screw 41 and the second screw 42 and is then supplied to the developing roller 11 through the supply roller 12.

At this time, since the toner supply chamber 23 and the toner return chamber 24 are partitioned by the first partition wall 34, it is possible to suppress the toner, which is supplied from the supply roller 12 to the developing roller 11, from being excessively supplied from the toner supply chamber 23 to the toner return chamber 24.

The toner scraped off from the developing roller 11 by the layer thickness regulation blade 13 is conveyed forwards by the first conveyance member 53 and is then collected into the toner accommodation chamber 14.

Therefore, it is possible to suppress the toner, which is scraped off from the developing roller 11 by the layer thickness regulation blade 13, from excessively remaining or staying in the nip portion between the developing roller 11 and the supply roller 12.

As a result, even when a supply speed of the toner from the supply roller 12 to the developing roller 11 is increased, it is possible to prevent the toner from being leaked from a vicinity of the developing roller 11.

(2) As shown in FIG. 2, according to the developing cartridge 7, the first partition wall 34 covers the front half of the supply roller 12.

Therefore, it is possible to suppress the toner, which is conveyed by the first conveyance member 53 and scraped off by the layer thickness regulation blade 13, from being again supplied to the supply roller 12.

As a result, it is possible to further suppress the toner, which is scraped off from the developing roller 11 by the layer thickness regulation blade 13, from excessively remaining or staying in the nip portion between the developing roller 11 and the supply roller 12.

(3) As shown in FIG. 2, according to the developing cartridge 7, the upper surface (a surface facing the toner return chamber 24) of the rear half part of the first partition wall 34 is inclined downwards as it is directed forwards.

Therefore, it is possible to securely convey the toner forwards, which is conveyed by the first conveyance member 53, by the inclination of the upper surface of the rear half part of the first partition wall 34.

As a result, it is possible to further suppress the toner, which is scraped off from the developing roller 11 by the layer thickness regulation blade 13, from excessively remaining or staying in the nip portion between the developing roller 11 and the supply roller 12.

(4) As shown in FIG. 3, according to the developing cartridge 7, the second screw 42 conveys the developer in the left-right direction.

Therefore, it is possible to uniformly supply a sufficient amount of the toner to the supply roller 12 in the left-right direction.

When the toner supplied from the toner accommodation chamber 14 is configured so that it is conveyed in the left-right direction and collected into the toner accommodation chamber 14, it is possible to make an amount of the toner in the toner accommodation chamber 14 uniform and to thus suppress the toner from being excessively supplied to the supply roller 12.

As a result, it is possible to suppress the toner, which is supplied from the supply roller 12 to the developing roller 11, from being excessively supplied from the toner supply chamber 23 to the toner return chamber 24.

(5) As shown in FIG. 2, according to the developing cartridge 7, the rotating center of the second screw 42 is positioned to be lower than the rotating center of the supply roller 12.

That is, the second screw 42 faces the lower circumferential surface of the supply roller 12 in a gravity direction.

Therefore, it is possible to suppress the toner from being excessively supplied from the second screw 42 to the supply roller 12 due to the gravity.

As a result, it is possible to further suppress the toner, which is scraped off from the developing roller 11 by the layer thickness regulation blade 13, from excessively remaining or staying in the nip portion between the developing roller 11 and the supply roller 12.

(6) As shown in FIG. 2, according to the developing cartridge 7, the toner return chamber 24 is provided therein with the second conveyance member 54 that is arranged more closely to the toner accommodation chamber 14 than the first conveyance member 53.

Therefore, it is possible to securely collect the toner, which is conveyed forwards by the first conveyance member 53, into the toner accommodation chamber 14 by the second conveyance member 54.

(7) As shown in FIGS. 3 and 4, according to the developing cartridge 7, the agitator 27 in the toner accommodation chamber 14 conveys the toner in the toner accommodation chamber 14 from the left side to the right side from the collection port 26 towards the supply port 25.

Thereby, the toner returned from the return port 26 to the toner accommodation chamber 14 is sequentially conveyed towards the supply port 25, so that it is possible to suppress the toner from excessively remaining or staying in the vicinity of the return port 26.

As a result, it is possible to prevent the return port 26 from being blocked due to the toner and thus to smoothly circulate the toner in the developing cartridge 7.

5. Second Illustrative Embodiment

A developing cartridge 70 of a second illustrative embodiment is described with reference to FIGS. 5 to 7. In the developing cartridge 70 of the second illustrative embodiment, the same members as those of the developing cartridge 7 of the first illustrative embodiment are denoted with the same reference numerals and the descriptions thereof are omitted.

(1) Outline of Second Illustrative Embodiment

In the developing cartridge 7 of the first illustrative embodiment, the toner supply chamber 23 is partitioned into the first supply chamber 37 and the second supply chamber 38 and the toner is circulated between the first supply chamber 37 and the second supply chamber 38.

Figure 6:
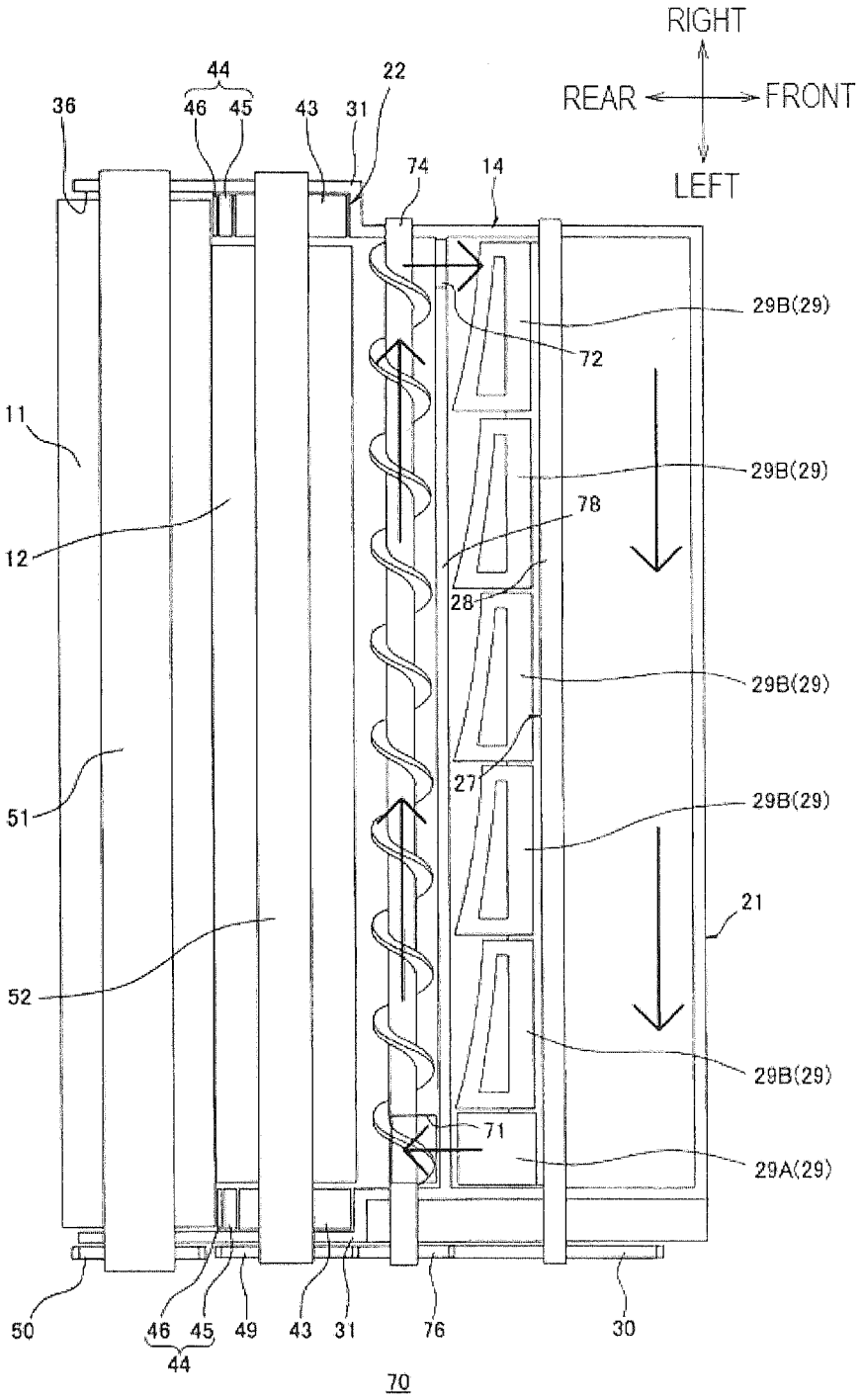
FIG. 6 is a C-C sectional view of FIG. 5.
Figure 7:
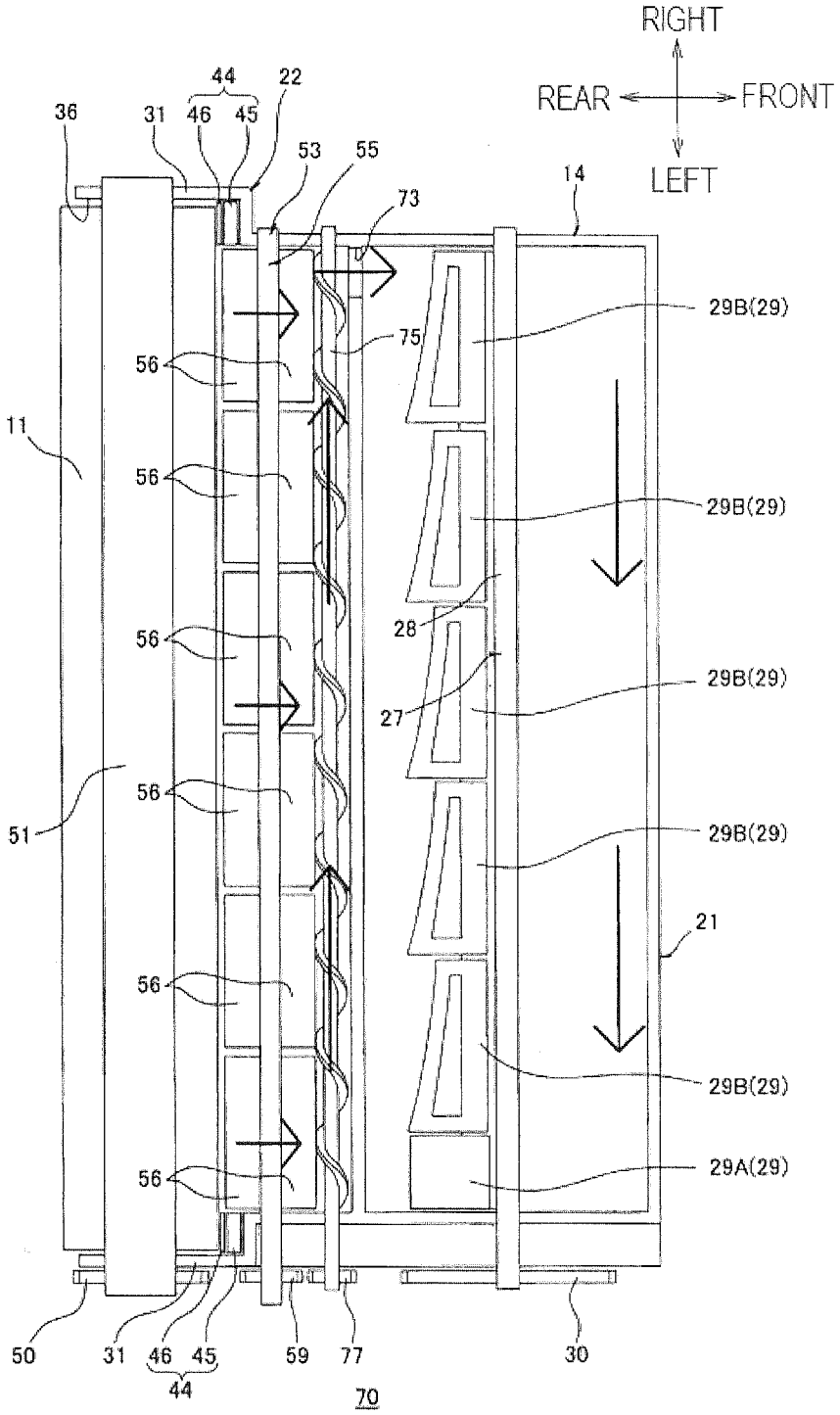
FIG. 7 is a D-D sectional view of FIG. 5.

Compared to this, in the developing cartridge 70 of the second illustrative embodiment, as shown in FIGS. 6 and 7, the toner supply chamber 23 is not partitioned and the toner is circulated between the toner supply chamber 23 and the toner accommodation chamber 14.

(2) Configuration of Second Illustrative Embodiment

The toner accommodation chamber 14 of the developing cartridge 70 of the second illustrative embodiment is formed with a protrusion part 78 and a return port 73.

The protrusion part 78 is formed on a peripheral wall of a rear-lower end portion of the toner accommodation chamber 14 and has a substantially circular arc shape that protrudes inwards in the diametrical direction of the toner accommodation chamber 14, when seen from a section. The protrusion part 78 is formed with a toner supply port 71 and a toner collection port 72.

The toner supply port 71 penetrates a left end portion of an upper peripheral wall of the protrusion part 78 in the upper-lower direction.

The toner collection port 72 penetrates a right end portion of a front peripheral wall of the protrusion part 78 in the front-rear direction.

The return port 73 is arranged above the protrusion part 78 and penetrates a right end portion of a rear peripheral wall of the toner accommodation chamber 14 in the front-rear direction.

The developing unit 22 is provided therein with a partition wall 69.

The partition wall 69 is formed at a substantial center of the toner accommodation chamber 14 in the upper-lower direction and has a substantially flat plate shape that extends towards the rear-upper side continuously from the upper side of the protrusion part 78 and the lower side of the return port 73. The partition wall 69 is bent rearwards as it is directed towards the rear-upper side so that it follows the outer periphery of the supply roller 12. A rear end portion of the partition wall 69 is arranged to face the front side of the developing roller 11 at an interval at the upper side of an upper end portion of the supply roller 12.

The internal space of the developing unit 22 is partitioned into the toner supply chamber 23 below the partition wall 69 and the toner return chamber 24 above the partition wall 69 by the partition wall 69.

The toner supply chamber 23 is provided with a screw 74.

The screw 74 is arranged in the front end portion of the toner supply chamber 23 along the left-right direction at the lower side of the protrusion part 78. The screw 74 is an auger screw of a left-hand thread shape that extends in the left-right direction. A right end portion of the screw 74 is rotatably supported to the right sidewall 31. A left end portion of the screw 74 is rotatably supported to the left sidewall 31 so that it protrudes leftwards from the left sidewall 31. A screw driving gear 76 is supported to the left end portion of the screw 74 at the left side of the left sidewall 31 so that it cannot be relatively rotated.

The screw driving gear 76 has a substantial disc plate shape having a thickness in the left-right direction. A periphery of the screw driving gear 76 is formed with gear teeth over an entire circumference thereof. The screw driving gear 76 is meshed with the agitator driving gear 30 from the rear side and is meshed with the supply roller driving gear 49 from the front side.

The toner return chamber 24 is provided with a second conveyance member 75.

The second conveyance member 75 is arranged at an interval from a front-lower side of the first conveyance member 53 at the rear side of the return port 73 and at the upper side of the partition wall 69. The second conveyance member 75 is an auger screw of a left-hand thread shape that extends in the left-right direction. A right end portion of the second conveyance member 75 is rotatably supported to the right sidewall 31. A left end portion of the second conveyance member 75 is rotatably supported to the left sidewall 31 so that it protrudes leftwards from the left sidewall 31. A second conveyance member driving gear 77 is supported to the left end portion of the second conveyance member 75 at the left side of the left sidewall 31 so that it cannot be relatively rotated.

The second conveyance member driving gear 77 has a substantial disc plate shape having a thickness in the left-right direction. A periphery of the second conveyance member driving gear 77 is formed with gear teeth over an entire circumference thereof.

(3) Driving of Developing Cartridge in Second Illustrative Embodiment

When a driving force is input from a driving transmission member (not shown) in the body casing 2 to a passive member (not shown) of the developing cartridge 7, the driving force is input from the passive member to the developing roller driving gear 50, the supply roller driving gear 49 and the first conveyance member driving gear 59, so that the developing roller driving gear 50, the supply roller driving gear 49 and the first conveyance member driving gear 59 are rotated in a counterclockwise direction, when seen from the left side surface.

Figure 5:
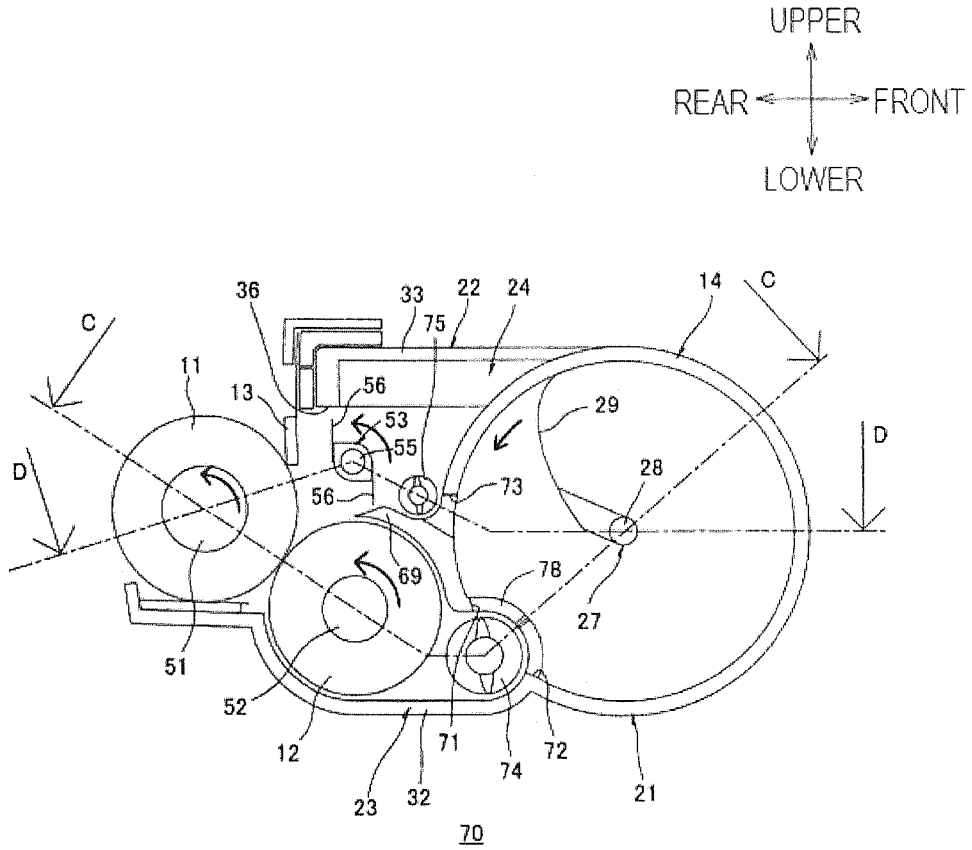
FIG. 5 is a side sectional view showing a second illustrative embodiment of the developing cartridge.

Then, as shown in FIGS. 5 and 6, the driving force is input from the developing roller driving gear 50 to the developing roller shaft 51, so that the developing roller 11 is rotated in the counterclockwise direction, when seen from the left side surface.

The driving force is input from the supply roller driving gear 49 to the supply roller shaft 52, so that the supply roller 12 is rotated in the counterclockwise direction, when seen from the left side surface.

Then, the driving force is transmitted to the screw driving gear 76 meshed with the supply roller driving gear 49, so that the screw driving gear 76 is rotated in a clockwise direction, when seen from the left side surface.

Thereby, the driving force is input from the screw driving gear 76 to the screw 74, so that the screw 74 is rotated in the clockwise direction, when seen from the left side surface.

The driving force is transmitted to the agitator driving gear 30 meshed with the screw driving gear 76, so that the agitator driving gear 30 is rotated in the counterclockwise direction, when seen from the left side surface.

Thereby, the driving force is input from the agitator driving gear 30 to the agitator shaft 28, so that the agitator 27 is rotated in the counterclockwise direction, when seen from the left side surface.

As shown in FIGS. 5 and 7, when the driving force is input from the passive member (not shown) to the first conveyance member driving gear 59, the driving force is input from the first conveyance member driving gear 59 to the shaft 55, so that the first conveyance member 53 is rotated in the counterclockwise direction, when seen from the left side surface.

The driving force is transmitted from the passive member (not shown) to the second conveyance member driving gear 77 through a gear train (not shown), so that the second conveyance member driving gear 77 is rotated in the counterclockwise direction, when seen from the left side surface.

Thereby, the driving force is input from the second conveyance member driving gear 77 to the second conveyance member 75, so that the second conveyance member 75 is rotated in the counterclockwise direction, when seen from the left side surface.

(4) Toner Supply Operation in Second Illustrative Embodiment

As shown in FIGS. 5 and 6, when the developing cartridge 70 is driven, the toner in the toner accommodation chamber 14 is conveyed from the right side to the left side in the toner accommodation chamber 14 by the rotation of the agitator 27 and is supplied into the toner supply chamber 23 through the toner supply port 71.

The toner supplied into the toner supply chamber 23 is conveyed from the left side to the right side in the toner supply chamber 23 by the rotation of the screw 74 and is carried on the surface of the supply roller 12 during the conveyance.

In the meantime, the toner that is not carried on the surface of the supply roller 12 is continuously conveyed from the left side to the right side in the toner supply chamber 23 by the rotation of the screw 74 and is collected into the toner accommodation chamber 14 through the toner collection port 72. That is, the toner is circulated between the toner supply chamber 23 and the toner accommodation chamber 14.

The toner carried on the surface of the supply roller 12 is friction-charged in the nip portion between the developing roller 11 and the supply roller 12 and is then carried on the surface of the developing roller 11.

The toner carried on the surface of the developing roller 11 is regulated in terms of a thickness thereof by the layer thickness regulation blade 13 so that it becomes a thin layer having a predetermined thickness.

At this time, the surplus toner of the toner carried on the surface of the developing roller 11 is scraped off by the layer thickness regulation blade 13.

The toner scraped off by the layer thickness regulation blade 13 is dropped to the nip portion between the developing roller 11 and the supply roller 12 by an own weight thereof.

The toner dropped to the nip portion between the developing roller 11 and the supply roller 12 is conveyed forwards by the rotation of the first conveyance member 53, as shown in FIGS. 5 and 7.

Then, the toner conveyed by the first conveyance member 53 is slid along the inclination of the partition wall 69 and is dropped to the front-lower side.

The toner slid and dropped along the upper surface of the partition wall 69 is conveyed from the left side to the right side by the rotation of the second conveyance member 75 and is then collected into the toner accommodation chamber 14 through the return port 73.

(5) Operational Effects in Second Illustrative Embodiment

In the second illustrative embodiment, the same operational effects as the first illustrative embodiment can be realized.

6. Modified Embodiments (1) In the first illustrative embodiment, the front half part of the first partition wall 34 is formed to horizontally extend in the front-rear direction and the rear half part of the first partition wall 34 is bent rearwards as it is directed towards the rear-upper side so that it follows the outer periphery of the supply roller 12.

Figure 8:
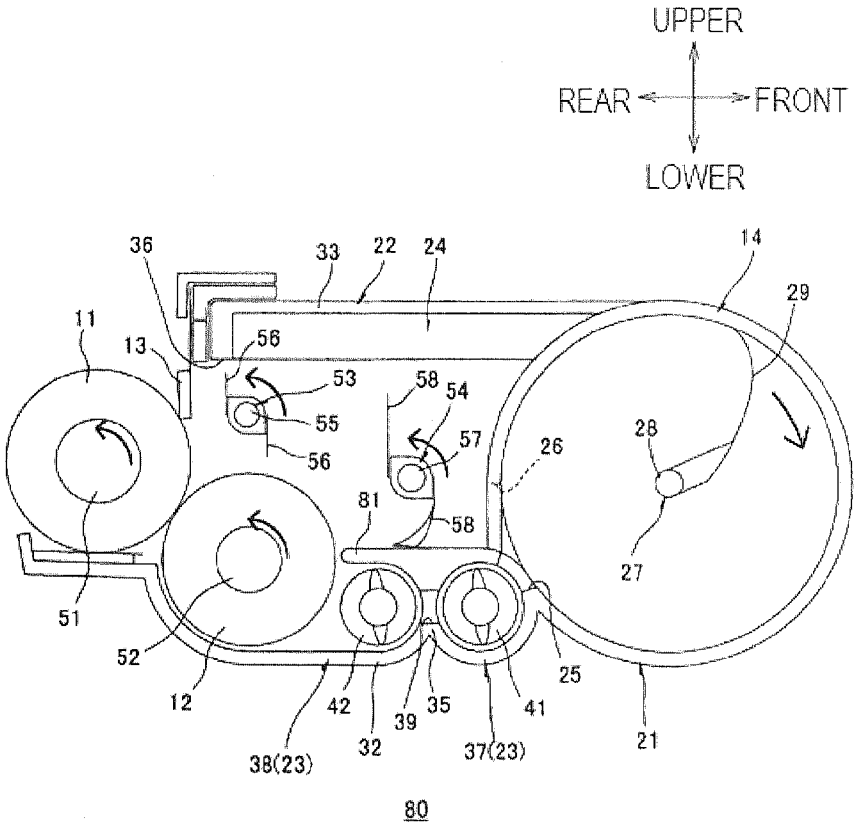
FIG. 8 illustrates a first modified embodiment of the developing cartridge.

Compared to this, in this modified embodiment, the first partition wall 34 is not provided with the rear half part following the outer periphery of the supply roller 12, as shown in FIG. 8.

In this modified embodiment, the similar operational effects to the first illustrative embodiment can be realized.

(2) In the second illustrative embodiment, the partition wall 69 is bent rearwards as it is directed towards the rear-upper side so that it follows the outer periphery of the supply roller 12.

Figure 9:
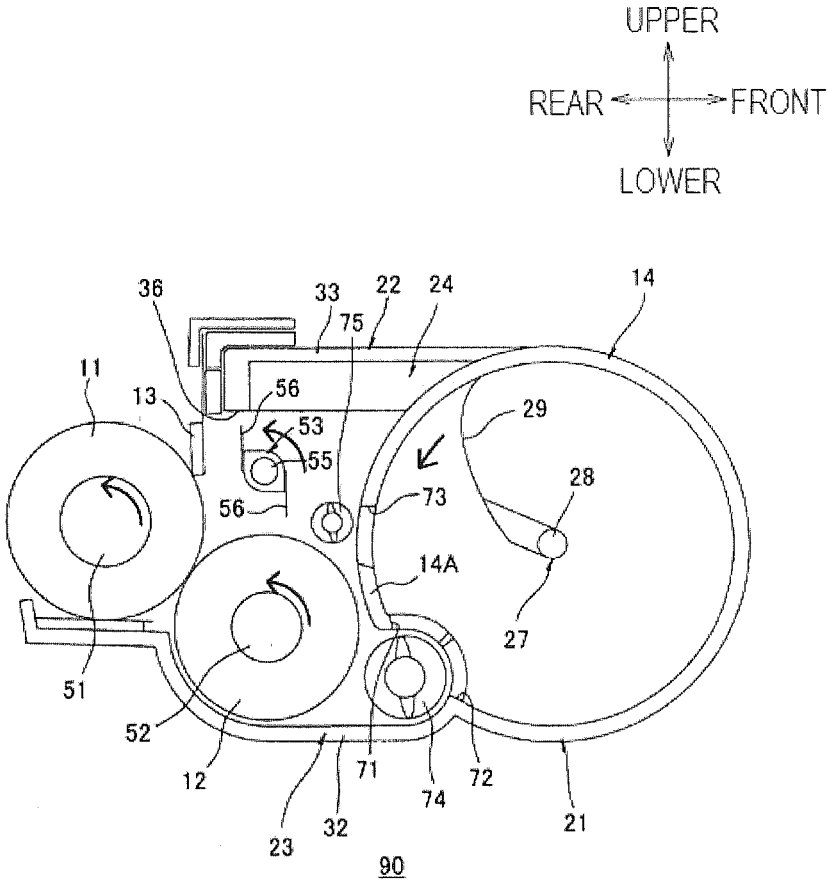
FIG. 9 illustrates a second modified embodiment of the developing cartridge.

Compared to this, in this modified embodiment, as shown in FIG. 9, the supply roller 12 is arranged in the vicinity of the rear side of the toner accommodation chamber 14, and the toner supply chamber 23 and the toner return chamber 24 are partitioned using a rear peripheral wall 14A of the toner accommodation chamber 14 at the rear side of the toner supply port 71 and at the lower side of the return port 73. That is, the rear peripheral wall 14A of the toner accommodation chamber 14 is an example of the partition wall.

In this modified embodiment, the similar operational effects to the first illustrative embodiment can be realized.

(3) In the second illustrative embodiment, the second conveyance member 75 is provided at the rear side of the return port 73 and the toner conveyed by the first conveyance member 53 is collected into the toner accommodation chamber 14 by the second conveyance member 75.

Figure 10:
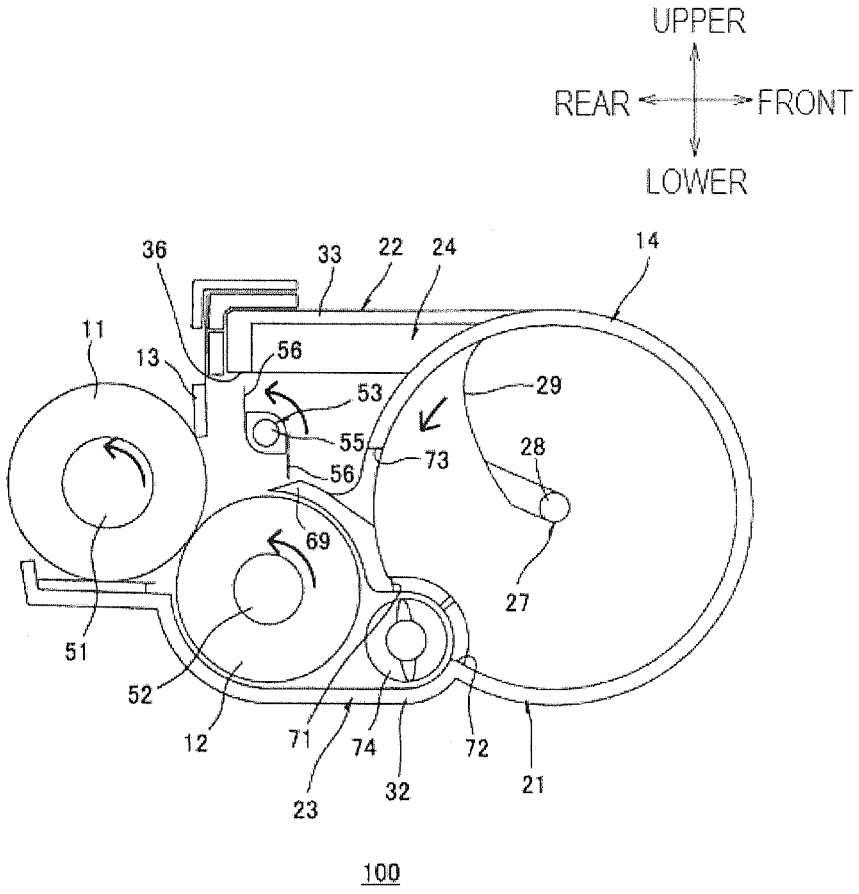
FIG. 10 illustrates a third modified embodiment of the developing cartridge.

Compared to this, in this modified embodiment, as shown in FIG. 10, the second conveyance member 75 is not provided. The return port 73 is formed over an entire width of the peripheral wall of the toner accommodation chamber 14 in the left-right direction between both sidewalls 31.

In this modified embodiment, the toner conveyed by the first conveyance member 53 is collected into the toner accommodation chamber 14 through the return port 73 so that it is slid and dropped along the upper surface of the partition wall 69.

In this modified embodiment, the similar operational effects to the first illustrative embodiment can be realized.

The image forming apparatus according to the exemplary embodiment can be configured as a color printer, in addition to the monochrome printer.

When the image forming apparatus is configured as a color printer, it can be configured as a direct tandem-type color printer having a plurality of photosensitive members and a recording medium conveyance member or as a tandem-type color printer of an intermediate transfer mode having a plurality of photosensitive members, an intermediate transfer member and a transfer member.

The process cartridge 5 may be also configured as an integral type in which the drum cartridge 6 and the developing cartridge 7 are integrally provided, in addition to the above separation type in which the drum cartridge 6 and the developing cartridge 7 are separated.

Only the developing cartridge 7 may be attached and detached to and from the body casing 2 at a state where the drum cartridge 6 is mounted to the body casing 2.

The developing cartridge 7 may be configured so that a toner cartridge accommodating therein the toner is detachably mounted to a frame having the developing roller 11.

A photosensitive member such as photosensitive belt and the like may be applied, instead of the photosensitive drum 8.

A developer carrier such as a developing sleeve, a developing belt, a brush-shaped roller and the like may be applied, instead of the developing roller 11.

A supply member such as a supply sleeve, a supply belt, a brush-shaped roller and the like may be applied, instead of the supply roller 12.

A conveyance member such as an auger screw, a conveyance belt and the like may be applied, instead of the agitator 27.

A contact-type transfer member such as a transfer belt, a transfer brush, a transfer blade, a film-type transfer device and the like or a non-contact-type transfer member such as a corotron-type may be applied, instead of the transfer roller 10.

A corotron-type charger, a non-contact-type charger such as tooth-shaped discharge member or a contact-type charger such as charging roller may be applied, instead of the scorotron-type charger 9.

An exposure member such as LED unit may be applied, instead of the scanner unit 15.

The image forming apparatus according to the exemplary embodiment may be configured as a complex machine having an image reading unit and the like.

What is claimed is:

1. A developing device comprising:

a developing frame having an opening that extends in a longitudinal direction thereof, the developing frame including a developer accommodation chamber configured to accommodate developer;

a developing roller configured to rotate about a first axis;

a supply roller that is configured to rotate about a second axis parallel to the first axis and supply the developer to the developing roller, the supply roller having a surface contacting a surface of the developing roller;

a layer thickness regulation member that is configured to regulate a layer thickness of the developer carried on the developing roller;

a developer supply chamber provided between the developing roller and the developer accommodation chamber in a direction perpendicular to the first axis, the developer supply chamber being connected to the developer accommodation chamber via a first port, the developer supply chamber being configured to supply the developer, which is supplied from the developer accommodation chamber, to the supply roller;

a developer return chamber that is provided between the developing roller and the developer accommodation chamber in the direction perpendicular to the first axis is arranged above the developer supply chamber, is connected to the developer accommodation chamber via a second port, and is configured to return the developer, which is scraped off from the developing roller by the layer thickness regulation member, to the developer accommodation chamber via the second port;

a partition wall extending from the supply roller and the developer accommodation chamber, the partitioning wall partitioning the developer supply chamber and the developer return chamber; and a first developer returning unit provided in the developer return chamber, the first developer returning unit configured to convey developer on the partition wall from the developer return chamber to the developer accommodation chamber, wherein the supply roller is provided between the developing roller and the developer accommodation chamber in the developer supply chamber, wherein the developer is allowed to circulate from the developer accommodation chamber to the developer supply chamber via the first port, from the developer supply chamber to the supply roller, from the supply roller to the developing roller, from the developing roller to the developer return chamber, and from the developer return chamber to the developer accommodation chamber via the second port, wherein the developer return chamber is provided with a second developer returning unit provided between the first developer returning unit and the developer accommodation chamber in the developer return chamber, the second developer returning unit configured to convey the developer on the partition wall from the first developer returning unit to the developer accommodation chamber, wherein the developing device further comprises:

a first developer conveying unit provided between the supply roller and the developer accommodation chamber in the developer supply chamber, the first developer conveying unit configured to convey the developer from the developer accommodation chamber; and a second developer conveying unit provided between the first developer conveying unit and the supply roller in the developer supply chamber, wherein the first developer conveying unit is configured to convey the developer from the developer accommodation chamber to the second developer conveying unit, wherein the second developer conveying unit is configured to convey the developer from the first developer conveying unit to the supply roller, wherein the first port connects the developer accommodation chamber to the developer supply chamber including the first developer conveying unit and the second developer conveying unit, wherein the second port connects the developer accommodation chamber to the developer return chamber including the first developer returning unit and the second developer returning unit, wherein the partition wall extends between the supply roller and the developer accommodation chamber, and wherein the first developer conveying unit and the second developer conveying unit are positioned at an opposite side of the second developer returning unit relative to the partition wall.

2. The developing device according to claim 1, wherein the partition wall is formed to cover at least a part of the supply roller.

3. The developing device according to claim 1, wherein a surface of the partition wall facing the developer return chamber is inclined downwards towards the developer accommodation chamber.

4. The developing device according to claim 1, wherein the developer supply chamber is configured to convey the developer along the longitudinal direction.

5. The developing device according to claim 1, wherein the developer supply chamber includes a developer conveying unit configured to convey developer towards the supply roller, a rotating center of the developer conveying unit is positioned to be lower than a rotating center of the supply roller.

6. The developing device according to claim 1, wherein a surface of the partition wall facing the developer return chamber is inclined downward toward the second port.

7. The developing device according to claim 1, wherein a surface of the partition wall facing the developer return chamber is inclined downward from the first developer returning unit to the second developer returning unit.

8. The developing device according to claim 1, wherein the developer return chamber is configured to directly return the developer, which is scraped off from the developing roller by the layer thickness regulation member, to the developer accommodation chamber without passing through the developer supply chamber.

9. A developing device comprising:

a developing roller configured to rotate about a first axis;

a developer accommodation chamber configured to accommodate developer;

a developer supply chamber provided between the developing roller and the developer accommodation chamber in a direction perpendicular to the first axis, the developing supply chamber being connected to the developer accommodation chamber via a first port;

a developer return chamber provided between the developing roller and the developer accommodation chamber in the direction, the developer return chamber being arranged above the developer supply chamber, the developer return chamber being connected to the developer accommodation chamber via a second port;

a layer thickness regulation member configured to regulate a layer thickness of the developer on the developing roller;

a supply roller configured to rotate about a second axis parallel to the first axis and supply the developer to the developing roller, the supply roller being provided between the developing roller and the developer accommodation chamber in the developer supply chamber, the supply roller having a surface contacting a surface of the developing roller;

a partition wall extending from the supply roller and the developer accommodation chamber, the partition wall partitioning the developer supply chamber and the developer return chamber; and a first developer returning unit provided in the developer return chamber, the first developer returning unit configured to convey developer on the partition wall from the developer return chamber to the developer accommodation chamber, wherein the developer is allowed to circulate from the developer accommodation chamber to the developer supply chamber via the first port, from the developer supply chamber to the supply roller, from the supply roller to the developing roller, from the developing roller to the developer return chamber, and from the developer return chamber to the developer accommodation chamber via the second port, wherein the developer return chamber is provided with a second developer returning unit provided between the first developer returning unit and the developer accommodation chamber in the developer return chamber, the second developer returning unit configured to convey the developer on the partition wall from the first developer returning unit to the developer accommodation chamber, wherein the developing device further comprises:

a first developer conveying unit provided between the supply roller and the developer accommodation chamber in the developer supply chamber, the first developer conveying unit configured to convey the developer from the developer accommodation chamber; and a second developer conveying unit provided between the first developer conveying unit and the supply roller in the developer supply chamber, wherein the first developer conveying unit is configured to convey the developer from the developer accommodation chamber to the second developer conveying unit, wherein the second developer conveying unit is configured to convey the developer from the first developer conveying unit to the supply roller, wherein the first port connects the developer accommodation chamber to the developer supply chamber including the first developer conveying unit and the second developer conveying unit, wherein the second port connects the developer accommodation chamber to the developer return chamber including the first developer returning unit and the second developer returning unit, wherein the partition wall extends between the supply roller and the developer accommodation chamber, and wherein the first developer conveying unit and the second developer conveying unit are positioned at an opposite side of the second developer returning unit relative to the partition wall.

10. The developing device according to claim 9, wherein a surface of the partition wall facing the developer return chamber is inclined downward toward the developer accommodation chamber.

11. The developing device according to claim 9, wherein a surface of the partition wall facing the developer return chamber is inclined downward toward the second port.

12. The developing device according to claim 9, wherein a surface of the partition wall facing the developer return chamber is inclined downward from the first developer returning unit to the second developer returning unit.

13. The developing device according to claim 9, wherein the developer return chamber is configured to directly return the developer, which is scraped off from the developing roller by the layer thickness regulation member, to the developer accommodation chamber without passing through the developer supply chamber.

14. The developing device according to claim 9, wherein the second port is located above the first port.

15. The developing device according to claim 1, wherein the second port is located above the first port.

* * * * *